US007014086B2

(12) United States Patent
Dittrich et al.

(10) Patent No.: US 7,014,086 B2
(45) Date of Patent: Mar. 21, 2006

(54) IGNITION DEVICE FOR IGNITING A FOIL CARTRIDGE IN AN EXPLOSION-OPERATED POWER TOOL

(75) Inventors: Tilo Dittrich, Feldkirch (AT); Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/737,275

(22) Filed: Dec. 16, 2003

(65) Prior Publication Data

US 2004/0182906 A1 Sep. 23, 2004

(30) Foreign Application Priority Data

Dec. 19, 2002 (DE) ..... 102 59 776

(51) Int. Cl.
*B25C 1/08* (2006.01)

(52) U.S. Cl. ..... 227/9

(58) Field of Classification Search ..... 227/9, 227/10, 8, 11; 89/1.11; 123/46 SC, 46 E, 123/24 R, 24 A, 143; 60/632, 637
See application file for complete search history.

(56) References Cited

U.S. PATENT DOCUMENTS 2,894,161 A * 7/1959 Sheheen ..... 313/131 R
3,219,866 A * 11/1965 Dingman ..... 313/118
3,748,770 A * 7/1973 Mitchell ..... 42/84
4,203,393 A * 5/1980 Giardini ..... 123/260
4,721,240 A * 1/1988 Cotta ..... 227/10
5,076,223 A * 12/1991 Harden et al. ..... 123/143 B
5,211,142 A * 5/1993 Matthews et al. ..... 123/143 B
5,617,925 A * 4/1997 Boothby et al. ..... 173/211
5,947,076 A * 9/1999 Srinivasan et al. ..... 123/267
6,102,270 A * 8/2000 Robinson ..... 227/10
6,257,476 B1 * 7/2001 Ehmig ..... 227/10
6,286,743 B1 * 9/2001 Ehmig ..... 227/9
6,321,733 B1 * 11/2001 Suckewer et al. ..... 123/620
6,363,898 B1 * 4/2002 Ripma et al. ..... 123/169 R
6,603,245 B1 * 8/2003 Fletcher ..... 313/141

FOREIGN PATENT DOCUMENTS

DE 19905549 8/2000
EP 1 027 962 * 8/2000

* cited by examiner

*Primary Examiner*—Stephen F. Gerrity
*Assistant Examiner*—Paul Durand
(74) *Attorney, Agent, or Firm*—Abelman, Frayne & Schwab

(57) ABSTRACT

An ignition device for igniting a foil cartridge (10) in an explosion-operated power tool includes an electrical insulator (24) arranged in the support (8), a pin-shaped electrode (25) located in the electrical insulator and having a tip (30) that communicates with surrounding environment via a channel (32) formed in the electrical insulator (24) and extending in a longitudinal direction of the pin-shaped electrode (25) and an electrically conducting annular electrode (27) supported on the support (8) in a region of the channel (32) and tightly surrounding the insulator (24), leaving the channel (32) free.

9 Claims, 1 Drawing Sheet

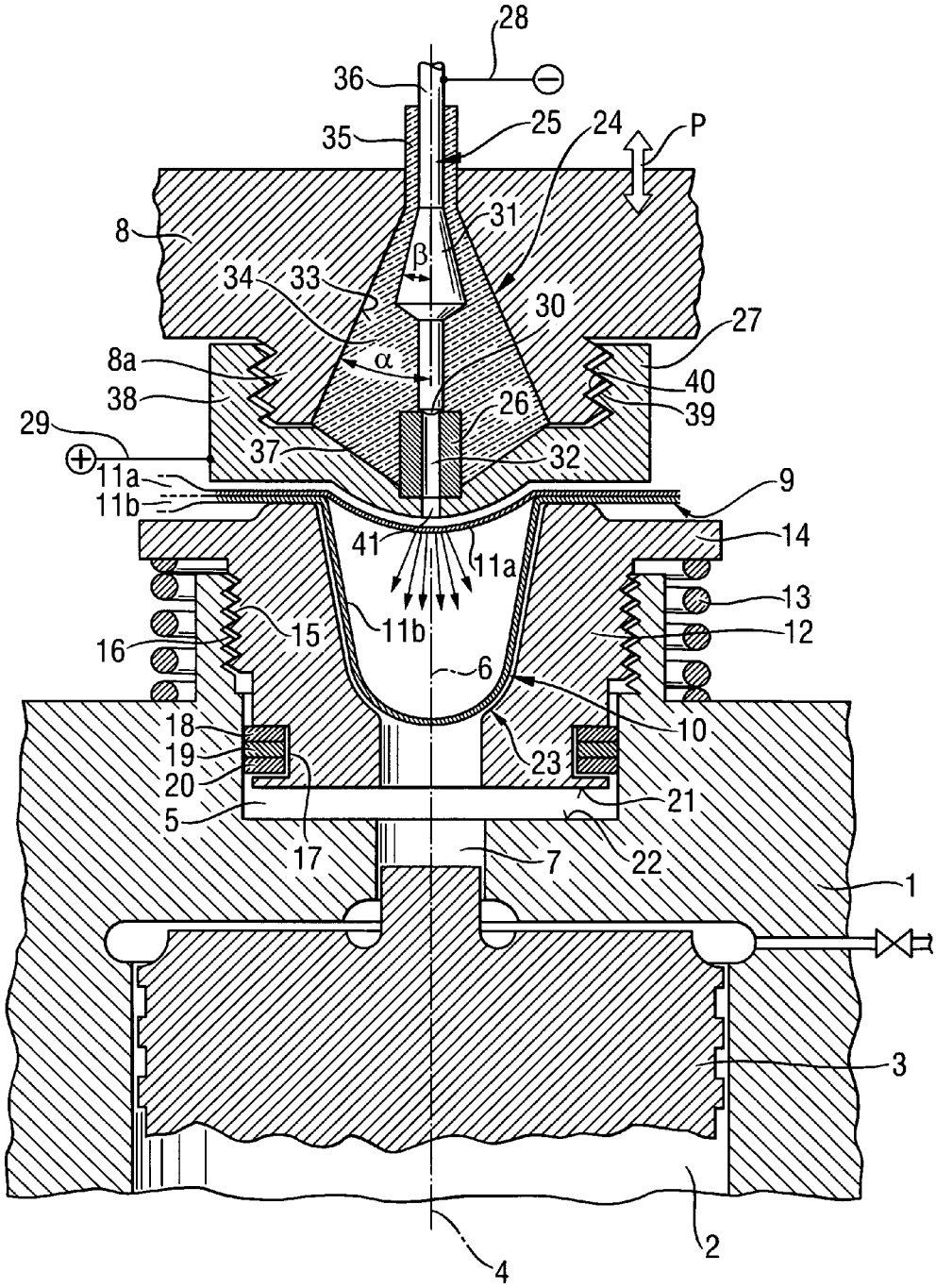
28
36
35
25
24
P
8
31
β
34
33
30
27
8a
α
40
38
26
39
29
37
32
11a
11b
9
41
14
11a
13
15
11b
12
16
6
18
10
19
23
20
21
5
17
7
22
1
3
2
4

IGNITION DEVICE FOR IGNITING A FOIL CARTRIDGE IN AN EXPLOSION-OPERATED POWER TOOL

BACKGROUND OF THE INVENTION

1. Field of the Invention

The present invention relates to an ignition device for igniting a foil cartridge in a power tool and, in particular, in a setting tool for driving in fastening elements such as nails, bolts and the like.

2. Description of the Prior Art

German Publication DE-199 05 549 A1 discloses an ignition device for igniting foil cartridges in an explosive powder charge-operated setting tool for driving in fastening elements. The ignition device includes a support, an electrical insulator arranged in the support, a pin-shaped electrode located in the electrical insulator and having a tip that communicates with surrounding environment via a channel formed in the electrical insulator and extending in a longitudinal direction of the pin-shaped electrode. The electrical insulator is pressed during a setting process against an electrically conducting foil that forms a bottom of a foil cartridge. The electrical arc, which is formed in the insulator channel melts the foil, which leads to ignition of a propellant contained in the cartridge.

The electrically conducting foil, which forms the cover strip of the foil cartridge, is formed by aluminum and has only a small durability. In addition, as a result of burning of aluminum, $Al_2O_3$ is formed.

However, the presence of $Al_2O_3$ in the power tools of this type is undesirable. Moreover, the insulator is mechanically not sufficiently rigid, and there is a danger of the central electrode being thrown out from the insulator upon build-up of high pressure resulting from the ignition of the cartridge. Furthermore, there exists a danger that hot, prestressed gases would flow through a gap between the electrode and the insulator and could cause further damage.

Accordingly, an object of the present invention is to provide an ignition device of the type described above and which has a mechanically rigid and reliable stricture.

Another object of the present invention is to provide an ignition device of the type described above and which would not require presence of electrically conducting elements on the foil cartridge.

SUMMARY OF THE INVENTION

These and other objects of the present invention, which will become apparent hereinafter, are achieved by providing in the ignition device such as disclosed in DE-199 05 549 A1, an electrically conducting annular electrode supported on the support in a region of the channel with the annular electrode tightly surrounding the insulator and leaving the channel free.

By using an electrically conductive annular electrode, it became possible to form an electrical arc for igniting the foil cartridge directly between the pin-shaped electrode and the annular electrode. Thereby, there is no need to use foil cartridges with electrically conductive region, e.g., foil cartridges with aluminum foils. This results in clean burning as no $Al_2O_3$ is formed, and the power tool does not become soiled. With replacement of the conventional aluminum foils by plastic foils, the temperature stability of the foil cartridges increases, as plastic foils have better properties than the aluminum foil.

In order to penetrate through the electrically non-conductive plastic foil, the pressure in the channel is increased. This is achieved by making the channel very narrow so that an arc discharge fills the entire channel. The electrical arc resulting for the discharge has a temperature of about 3000° C. to 4000° C. The high temperature and the high dissociation of gases in the electrical arc provide for a build-up of a very high pressure which is capable to cut through the plastic foil of the cartridge or melt the plastic foil through. The recombination of the plasma, upon cooling down, frees a noticeable amount of energy used for ignition of the cartridge or the propellant.

The annular electrode is formed advantageously as a cover that pushes the insulator into a conical cavity in the support. This substantially increases the durability of the insulator. In addition, the annular electrode forms a bulge in the direction toward the cartridge support, i.e., it is convexly shaped at its side remote from the insulator. As a result, the cover foil of a cartridge is better pressed against the annular electrode when the cartridge is pressed by an axially displaceable sealing sleeve against the support. This reduces the danger of hot gases weakening the cover foil and penetrating in a space between the annular electrode and the cover foil. The annular electrode prevents direct contact of the powder loose particle with the insulator, better protecting the same.

According to a preferred embodiment of the present invention, the insulator is formed of a plastic material, which makes it more elastic and, therefore, less brittle than a ceramic insulator.

According to another preferred embodiment of the present invention, the annular electrode is screwed on the support, which permits to easily remove it, if needed, and replace it with a new one or a different one.

Advantageously, the spiral thread, which is used for screwing the annular electrode on the support, has an axial play. Thereby, the annular electrode is capable of following the springing of the insulator, keeping the hot gases away from the insulatory upon ignition of a cartridge. Mechanically, the annular electrode is formed similar to a disc spring. The elasticity of the annular electrode protects the insulator from mechanical overloading due to thermal expansion.

According to yet another preferred embodiment, the circumferential wall of the channel is formed by a sleeve received in the insulator. The sleeve is formed of a temperature stable material, e.g., ceramic. The sleeve protects the insulator from the heat of the electrical arc. As a result, thermal expansions and mechanical tension spikes are compensated by resilience of the insulator material.

According to a still further preferred embodiment of the present invention, the insulator has a conical section, the cone angle of which opens in a direction toward the channel. The pin electrode likewise can be provided with a conical electrode section the cone angle of which likewise opens in a direction toward the channel. Preferably, the cone angle of the conical electrode section is smaller than the cone angle of the conical insulator section.

The conical electrode section of the pin electrode prevents removal of the insulator under the pressure of the powder swath upon ignition of the foil cartridge. It functions similar to a check valve, "swimming" in the ductile plastic material of the insulator. When the cone angle of the conical electrode section is smaller than the conical angle of the conical insulator section, a conical gap is formed between the two conical sections which tapers in the "flow direction" of the plastic material of the insulator. This also prevents an undesirable extrusion of the plastic material of the insulator. Finally, the conical electrode section of the pin electrode is pressed against the plastic material of the insulator by the interior ballistic pressure of the powder swath, sealing the insulator. This prevents a dangerous penetration of the powder swath between the pin electrode and the insulator. Thereby, a reliable tightness and durability of the insulator is obtained despite changing temperatures of the power tool.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows a cross-sectional view of an explosion-operated power tool in a region of its ignition device.

DETAILED DESCRIPTION OF THE PREFERRED EMBODIMENT

An ignition device according to the present invention for a foil cartridge for use in an explosion-operated power tool will be described by an example of its use in an explosive powder charge-operated power tool shown in the drawing. The power tool includes a housing 1 in which a cylindrical chamber 2 is formed. A drive piston 3 is arranged in the chamber 2 for displacement in the axial direction of the chamber 2. A central axis 4 of the chamber 2 extends in a longitudinal direction of the power tool. In the housing 1, there is formed a cylindrical cavity 5 the axis 6 of which coincides with the central axis 4 of the piston chamber 2. A connection channel 7, coaxial with respect to the central axis 4 of the piston chamber 2 and the axis 6 of the cylindrical cavity 5, connects the bottom region of the cavity 5 with the piston chamber 2.

Alternatively, the central axis 4 of the piston chamber 2 and the axis 6 of the cavity 5 can extend at an angle to each other, e.g., at a substantially right angle. In this case, a so-called "side-fire" concept is realized. With the respective axes extending at angle to each other, the cylindrical cavity 5 and the piston chamber 2 would be inclined to each other.

Opposite the open side of the cavity 5, a breech bottom 8 is located. The breech bottom 8 supports the ignition device of the power tool. The breech bottom 8 is axially displaceable, along the axes 4 and 6, toward and away from the housing 1 in directions shown with a double arrow P. A belt 9 with blister cartridges 10, which are connected with each other, is displaceable between the breech bottom 8 and the housing 1. In the drawing, one of the blister cartridges 10 is located in its ignition position. The blister cartridges are located only on one side of the belt 9, with the other side of the belt 10, the flat rear side, facing the breech bottom 8. When the breech bottom 8 is lifted relative to the housing 1, the belt 9 can be displaced in its longitudinal direction for removing the used cartridge and for placing a new cartridge in the ignition position. The belt 9 is formed by a plastic foil 11*a*. A cartridge sheath foil 11*b* is fixedly connected with the plastic foil 11*a* and is spaced therefrom for forming blister cartridges 10 or foil cartridges. The cartridge sheath foil 11*b* is likewise formed of a plastic material.

A sealing sleeve 12 is arranged in the cylindrical recess 5 of the housing 1. The sealing sleeve 12 is displaceably arranged and is displaceable in a longitudinal direction, i.e., in a direction of the axis 6. The sealing sleeve 12 is elastically, non-rigidly arranged in the recess 5. A spiral compression spring 13 surrounds the sealing sleeve 12. The compression spring 13 is supported, at its opposite ends, against the housing 1 and a surface of a flange 14 that forms an end surface of the sealing sleeve 12 and faces the housing 1. The compression spring 13 always biases the sealing sleeve 12 toward the breech bottom 8. In order to prevent the sealing sleeve 12 from being displaced out of the cylindrical cavity 5, the sealing sleeve 12 is provided with an outer circumferential thread 15 that is screwed into the inner thread 16 provided on the inner wall of the cylindrical recess 5. The axial gap is provided between the thread 15 and 16, which makes possible a slight displacement of the sealing sleeve 12 along the central axis 6. However, the threads 15, 16 prevent the sealing sleeve 12 from falling out of the cavity 5 under the action of the compression spring 13.

The sealing sleeve 12 has, on its lower section facing in the direction of the piston 3, an outer circumferential groove 17, in which there are located three so-called FEY-rings 18, 19, 20 that seal the gap between the outer circumferential surface of the sealing sleeve 12 and the inner wall of the cavity 5. The end surface 21 of the sealing sleeve 12, which faces in the direction of the piston 3, is spaced from the bottom 22 of the cylindrical cavity 5. The connection channel 7 extends from the bottom 22 of the cavity 5.

The sealing sleeve 12 has its inner space so deformed that a cartridge support 23 is formed. The inner cavity, which forms the cartridge support 23, has substantially the same shape as the blister cartridge 10 which is to be supported therein.

As it has already been discussed above, the breech bottom 8 supports the ignition device according to the present invention. The ignition device is arranged coaxially with the axis 6 opposite the cartridge support 23.

The ignition device includes an insulator 24, a pin-shaped electrode 25, a ceramic sleeve 26, and an annular electrode 27. The elements 24, 25 26, 27 are fixedly connected with the breech board 8 and are displaceable therewith. Conductors 28, 29 connect, respectively, the pin-shaped electrode 25 with a negative pole of a voltage source and the annular electrode 27 with a positive pole of the voltage source.

The pin-shaped electrode 25 is formed substantially as a cylindrical rod and has a tip 30 facing the cartridge support 23. The end of the electrode 25 remote from the tip 30 is connected with the conductor 28. Within the breech board 8, the electrode 25 has a cone-shaped section 31 spaced from the tip 30 and with its cone angle $\beta$ opening in a direction toward the cartridge support 23. In front of and behind the cone-shaped section 3, the electrode 25, as it has already been mentioned above, has a cylindrical shape having the same diameter. The pin-shaped electrode 25 extends coaxially with the central axis 6.

The ceramic sleeve 26, which is likewise arranged coaxially with the central axis 6, adjoins the tip 30. A channel 32, which has a very small diameter, extends through the ceramic sleeve 26. The channel 32 can also be referred to as a spinning chamber. Upon application of voltage to conductors 28 and 29, an electrical arc is formed therein.

Both the electrode 25 and the ceramic sleeve 26 are arranged in the insulator 24. The insulator 24, which is located in a conical cavity 33 in the breech bottom 8 opening in direction toward the cartridge support 23, circumferentially surrounds the electrode 25 and the ceramic sleeve 26. The insulator 24 is formed of a plastic material and is exactly fitted in the cavity 33. The insulator 24 has a conical section 34 a cone angle $\alpha$ of which opens in a direction toward the cartridge support 23. The cone-shaped insulator section 24 extends likewise coaxially with the central axis 6. At its end remote from the cartridge support 23, the cone-shaped section 34 passes into a cylindrical section 35 for insulating the rear end 36 of the electrode 25. At its end facing the cartridge support 23, the cone-shaped section 34 passes into a diminishing conical section 37 that expands in a direction toward the ceramic sleeve 26. The ceramic sleeve 26 slightly projects past the conical section 37.

The annular electrode 27 is screwed onto a projection 8*a* of the breech board 8 which projects in a direction toward the cartridge support 23 and a coaxial with central axis 6.

The annular electrode 27 is formed as a cover and has a circumferential flange 38 having an inner thread 39 that cooperates with an outer thread 40 of the projection 8*a*. The threads 39, 40 form an axial gap. The cover-shaped annular electrode 27 covers the conical section 37 of the insulator 24 and abuts the end surface of the ceramic sleeve 26 facing the cartridge support. The annular electrode 27 has a through-opening 41 coaxial with the central axis 6 and the diameter of which corresponds to the diameter of the channel 32 in the ceramic sleeve 26. The interior of the annular electrode 27 is conically shaped so that its cone shape corresponds to that of the conical section 37 of the insulator 24, whereby the interior of the electrode 27 closely surrounds the conical section 37.

Below the operation of the power tool will be described in detail. Firstly, the breech bottom 8 of the housing 1 is displaced along the central axis 6 away from the housing 1, providing sufficient space for transporting the belt 9 for arranging a blister cartridge 10 in a region between the breech bottom 8 and the housing 1. The sealing sleeve 12 is biased by the spring 13 in the direction toward the breech bottom 8. However, the displacement of the sealing sleeve 12 is by axial engagement of the threads 15, 11*b*.

When the breech bottom 8 is displaced in the direction toward the housing 1, it advances the belt 9 in this direction, pushing the blister cartridge 10 into the cartridge support 23. The displacement of the breech bottom 8 in the direction toward the housing 1 takes place until the compression spring 13 becomes compressed, with the sealing sleeve 12 being pressed, via the flange 14, in a direction toward the breech bottom 8. Thereby, a certain press-on force is generated in the circumferential region of the blister cartridge 10. If a voltage is transmitted to the electrodes 25 and 27 via the conductor 28, 29, respectively, an electric arc is formed in the channel 32 and melts through the cover foil 11*a* of the belt 9, which leads to ignition of the propellant in the blister cartridge 10. As a result of the build-up of high gas pressure within the cartridge support 23, the sealing sleeve 12 is pressed further, via its end surface 21, in the direction toward the breech bottom 8, completely sealing the region between the sealing sleeve 12 and the annular electrode 27. The piston 3 is accelerated in a direction toward the front end of the power tool for driving a fastening element (not shown) in an object (likewise not shown).

The high gas pressure that was produced in the cartridge support 23 as a result of the ignition of the blister cartridge 10, presses the insulator 24 and the pin shaped electrode 25 in a direction downward the breech bottom 8. However, both the insulator 24 and the electrode 25 cannot be expelled, being prevented from being expelled by the conical section 34 of the insulator 24 and by the conical section 32 of the electrode 25. A reliable sealing against gas emission is also formed in this region. This is because a type of a check valve is formed the wedge region between the breech bottom and the conical electrode section 31. In this region, the material of the insulator 24 is pressed into the inner wall of the cavity 33, insuring a better sealing.

On the other hand, the cover-shaped annular electrode 27 is retained on the projection 8*a* of the breech bottom 8 by cooperation of threads 39, 40. Because of the axial play between the threads 39, 40 the annular electrode 27, together with the insulator 24, is pressed, as a result of a high gas pressure in the cartridge support, in the direction toward the breech bottom 8. This prevents formation of a gap between the inner surface of the annular electrode 27 and the conical section 37 of the insulator 24 and through which gas can leak. The conical section 37 snugly fits in the cavity formed in the annular electrode 27, whereby the gap therebetween is always sealingly closed.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An ignition device for igniting a foil cartridge (10) in an explosion-operated power tool, comprising;

a displaceable support (8);

an electrical insulator (24) arranged in the displaceable support (8);

a pin-shaped electrode (25) located in the electrical insulator and having a tip (30) that communicates with surrounding environment via a channel (32) formed in the electrical insulator (24) and extending from the tip (30) in a longitudinal direct ion of the pin-shaped electrode (25); and an electrically conducting annular electrode (27) supported on the support (8) in a region of the channel (32), the annular electrode (27) tightly surrounding the insulator (24), leaving the channel (32) free, whereby an electrical arc is formed that extends from the tip (30) of the pin-shaped electrode (25) and longitudinally through the channel (32) to the annular electrode (27), the annular electrode (27) being displaceable together with the support (8), between a first position in which the annular electrode (27) is spaced from a cover (11*a*) of the foil cartridge (10), and a second position in which the annular electrode (27) contacts the cover of the foil cartridge.

2. An ignition device according to claim 1, wherein the insulator (24) has a conical section (34) a cone angle ($\alpha$) of which opens in a direction toward the channel (32).

3. An ignition device according to claim 2, wherein the pin-shaped electrode (25) has a conical section (31) a cone angle ($\beta$) of which opens in a direction toward the channel (32).

4. An ignition device according to claim 3, wherein the cone angle ($\beta$) of the electrode conical section (31) is smaller than the cone angle ($\alpha$) of the insulator conical section (34).

5. An ignition device according to claim 1, wherein a circumferential wall of the channel (32) is formed by a sleeve (26) located in the insulator (24) and formed of a temperature-stable material.

6. An ignition device according to claim 5, wherein the sleeve (26) is formed of ceramics.

7. An ignition device according to claim 1, wherein the annular electrode (27) is formed as a cover and has, at its side remote from the insulator (24), a convex bulge.

8. An ignition device according to claim 1, wherein the annular electrode (27) is secured on the support (8) by spiral thread means (39,40).

9. An ignition device according to claim 8, wherein the spiral thread means (39,40) have axial play.

* * * * *